US008662059B2

(12) United States Patent
Gschirr

(10) Patent No.: US 8,662,059 B2
(45) Date of Patent: Mar. 4, 2014

(54) DETERMINATION OF THE BURNING DURATION OF AN IGNITION SPARK

(75) Inventor: Arno Gschirr, Innsbruck (AT)

(73) Assignee: GE Jenbacher GmbH & Co OHG, Jenbach (AT)

( * ) Notice: Subject to any disclaimer, the term of this patent is extended or adjusted under 35 U.S.C. 154(b) by 254 days.

(21) Appl. No.: 13/171,860

(22) Filed: Jun. 29, 2011

(65) Prior Publication Data

US 2012/0031382 A1 Feb. 9, 2012

(30) Foreign Application Priority Data

Aug. 6, 2010 (AT) ..... A 1328/2010

(51) Int. Cl.
*F02P 3/05* (2006.01)

(52) U.S. Cl.
USPC ..... 123/623; 123/406.57; 123/607; 123/622; 123/644

(58) Field of Classification Search
USPC ..... 123/406.57, 605, 606, 607, 609, 620, 123/623, 644; 315/209 CD
See application file for complete search history.

(56) References Cited

U.S. PATENT DOCUMENTS 6,283,103 B1 9/2001 Hoeflich
6,457,464 B1 * 10/2002 Rapoport et al. ..... 123/605
6,701,896 B2 * 3/2004 Kiessling ..... 123/406.57
2002/0056445 A1 * 5/2002 Inagaki et al. ..... 123/609
2004/0211401 A1 * 10/2004 Schmolla ..... 123/609
2008/0035131 A1 * 2/2008 Kraus et al. ..... 123/623

FOREIGN PATENT DOCUMENTS

| | | |
|---|---|---|
| DE | 10 2007 051 249 | 4/2009 |
| EP | 0 707 144 | 4/1996 |
| EP | 1 854 998 | 11/2007 |
| WO | 94/27043 | 11/1994 |
| WO | 2009/053162 | 4/2009 |

OTHER PUBLICATIONS

Austrian Patent Office Search Report issued Feb. 4, 2011 in Austrian Patent Application No. A 1328/2010.

* cited by examiner

*Primary Examiner* — Stephen K Cronin
*Assistant Examiner* — Joseph Dallo
(74) *Attorney, Agent, or Firm* — Wenderoth, Lind & Ponack, LLP

(57) ABSTRACT

An ignition device has a high voltage transformer having a primary side and a secondary side, of which the primary side is connected to a high voltage source and the secondary side is connected to a spark path to provide the ignition spark. The time variation in the primary current flowing on the primary side is measured and subdivided at least into a spark burning phase and a subsequent free-running phase of the high voltage transformer. The transition from the spark burning phase into the free-running phase is equated to the moment of extinction of the ignition spark. The time variation of the primary current in the spark burning phase is mapped by a first function and in the free-running phase by a second function, and the intersection point of the two functions is equated to the moment of extinction of the ignition spark.

14 Claims, 4 Drawing Sheets

DETERMINATION OF THE BURNING DURATION OF AN IGNITION SPARK

BACKGROUND OF THE INVENTION

The invention concerns a method of determining the moment of extinction of an ignition spark of an ignition device for an internal combustion engine. The ignition device has a high voltage transformer having a primary side and a secondary side, of which the primary side is connected to a high voltage source and the secondary side is connected to a spark path to provide the ignition spark and an ignition device for an internal combustion engine. The high voltage transformer is, in particular, a coil having a primary side and a secondary side. A high voltage source is electrically connected to the primary side, and a spark path is electrically connected to the secondary side. The time variation in the primary current flowing on the primary side is measured and subdivided at least into a spark burning phase and a subsequent free-running phase of the high voltage transformer, and the transition from the spark burning phase into the free-running phase is equated to the moment of extinction of the ignition spark. The invention is also directed to an internal combustion engine having such an ignition device.

An aim to seek to achieve reliable ignition and cause firing of the combustible mixture is an ignition spark burning duration which is as long as possible.

Fuel mixtures can be caused to fire with a wide range of different methods. In the case of combustion engines such as, for example, a gas engine, in most cases the mixture is ignited by an ignition spark. There are a number of methods of ignition spark generation, primarily an ignition coil ignition system being used in that case. In that respect, for igniting the fuel mixture, it is primarily the plasma energy introduced by way of the spark passage (ionization and activation energy) that is decisive in terms of the quality of the subsequent combustion process. Besides the level of the ignition spark current, for ignition or firing of the fuel mixture, the ignition spark duration is substantially also decisive. Indirect and direct influences such as, for example, pressure, temperature, mixture composition and flow speeds in the combustion chamber, specifically in the region of the ignition spark plug electrodes or spark path, can considerably influence the ignition spark duration. Thus, determining the ignition spark duration is decisive for assessing the effectiveness of an ignition process. As a possible way of measuring the ignition spark duration, it is possible to employ the direct dependency in relation to the current in the high voltage circuit (secondary current of the ignition coil) which is to be equated to the spark current. Those possible ways of directly measuring the ignition spark duration are not possible with most ignition systems, more especially in the case of central ignition systems where only the primary side of the ignition coils is connected to the ignition system, and no measurement parameters can be passed back from the secondary side.

Some approaches for diagnosis of ignition events are known from the patent literature.

Thus, EP 707 144 A2 (ROBERT BOSCH GMBH) describes the use of a current measuring clip-on instrument for the diagnosis of ignition events. There is provided a first resonant circuit whose resonance frequency is matched to rapid changes in ignition current which occur during the beginning of the ignition spark, and there is a second resonant circuit whose resonance frequency is matched to slow changes in ignition current which occur during the ignition spark burning duration.

WO 1994/027043 (ROBERT BOSCH GMBH) proposes a method of detecting misfires. Here the transformed burning voltage on the primary side is used and a comparison is made with limit values for correct ignition.

FIG. 1 shows an ignition device in accordance with the state of the art. It has a high voltage transformer 3 having a primary side 4 and a secondary side 5. In the present case, the high voltage transformer 3 is in the form of a coil. The primary side 4 is connected to a high voltage source 6 through 9. The individual components of the high voltage source are a dc voltage source 6, a high voltage capacitor 7, a free-running diode 8 and a switching element 9.

The secondary side 5 of the high voltage transformer 3 is connected to a spark path 10 for producing the ignition spark.

FIG. 1 shows an ammeter 11 which is connected to the secondary side 5 of the high voltage transformer 3 and by means of which the secondary current can be measured in relation to ground. It is possible in that way to determine the ignition spark duration. It will be noted, however, that the measurement procedure as shown in FIG. 1 is not possible in by far the most ignition systems as in most ignition systems it is only the primary side 4 of the high voltage transformer 3 that is connected to the ignition system and no measurement parameters whatsoever can be passed back from the secondary side 5.

The methods used at the present time do not provide any information about the spark burning duration itself, but compare a parameter measured at the primary side (for example the burning voltage) to previously detected limit values for a correct ignition process.

Detection of the moment of extinction of the ignition spark is decisive for assessing the effectiveness of an ignition process.

A method of the general kind set forth is to be found in U.S. Pat. No. 6,283,103 B1.

SUMMARY OF THE INVENTION

Therefore, the object of the present invention is to provide a method which permits detection of the moment of extinction of the ignition spark and to provide an ignition device which can operate in accordance with that method.

The present invention is based on measurement of the moment of extinction of the ignition spark by the primary current of a high voltage transformer, in the normal case an ignition coil.

Investigations in respect of the primary and secondary circuit parameters of an ignition coil and the ignition spark have shown that the moment of extinction of the ignition spark can be ascertained by the variation in the primary current of an ignition coil.

The ignition process can generally be subdivided into four phases:

1. Ionization phase—build-up of the necessary high voltage and ionization for breakdown
2. Breakdown phase—build-up of the spark passage
3. Spark burning phase—energy transfer into the fuel mixture by the plasma energy
4. Coil free-running phase—reduction of the energy stored in the coil after extinction of the spark.

Each of the individual phases of the ignition spark has a typical characteristic, which can be recognized, for example, on the basis of the different slope angles of the primary current, caused by the influencing parameters acting in those phases on the primary current of the ignition coil.

If, for example, straight lines (linear functions) are put into the current variation curves in phases 3 and 4 and those straight lines are caused to intersect, it is then possible for the moment of extinction of the ignition spark to be determined in a very simple fashion from the position of the intersection points. Alternatively, a first function representing the time variation of the primary current in the spark burning phase and/or a second function representing the time variation of the primary current in the free-running phase can be a polynomial function of degree >1. The use of other functions is also conceivable.

Determining the ignition spark duration measurement of the moment of extinction of the ignition spark according to the invention may be sufficient if the moment of occurrence of the ignition spark can be derived from other data or is simply presupposed as being known.

The moment of occurrence of the ignition spark can be determined from the time variation in the primary current, more specifically by virtue of the transition from the ionization phase into the spark burning phase.

The ignition spark burning duration ascertained in that way can be used as a regulating parameter for the primary-side energy supply to the ignition coil in order to match the ignition spark characteristic to the conditions in the combustion chamber and thus to optimize the ignition and combustion process.

That prevents substantially slow or delayed combustion and further results in a lesser variance in the combustion process and thus more complete combustion of the fuel mixture, which is to be equated to a higher level of efficiency or an increase in the efficiency of the overall system of a combustion process.

BRIEF DESCRIPTION OF THE DRAWINGS

Further advantages and details of the invention will be apparent from the Figures and the related specific description, in which.

DETAILED DESCRIPTION OF THE INVENTION

Figure 1:
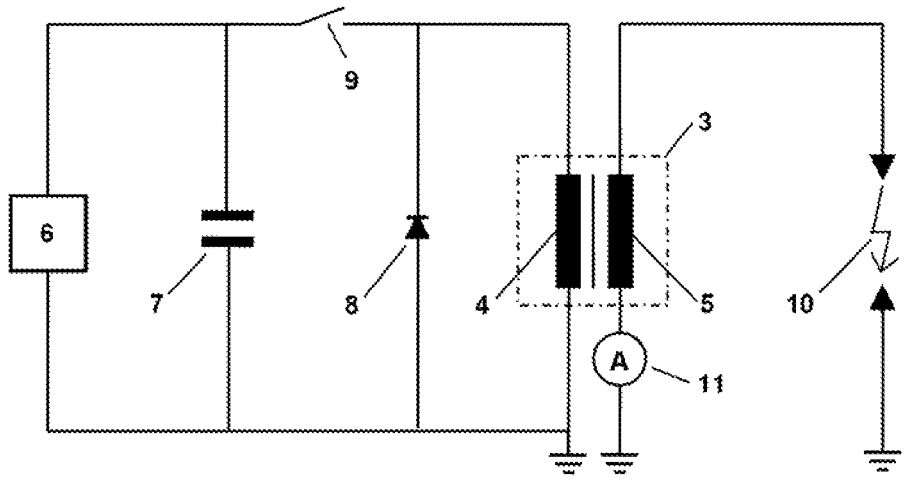
FIG. 1 shows an ignition device according to the state of the art.
Figure 2:
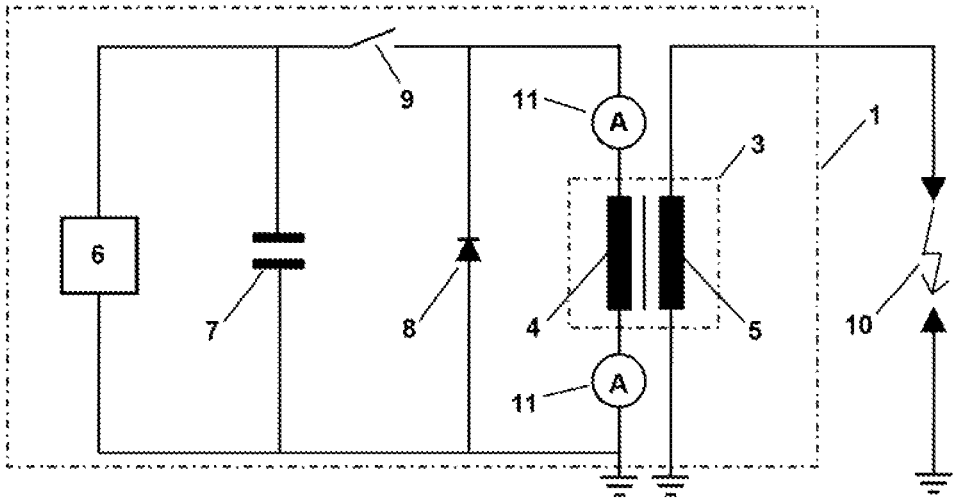
FIG. 2 shows an ignition device according to the invention.

FIG. 2 shows an ignition device 1 according to the invention, in which the method of operating the conventional ignition device of FIG. 1 could not be used at all. The same components as in FIG. 1 are denoted by the same references. According to the invention, it is now provided that at least one current measuring device (ammeter) 11 is connected to the primary side 4 of the high voltage transformer 3. FIG. 2 shows two alternative positions for the location of the current measuring device 11. In that case, the current measuring device for the primary current can be selectively effected, for example, with a current transducer or with a measuring resistor in relation to ground.

Figure 3:
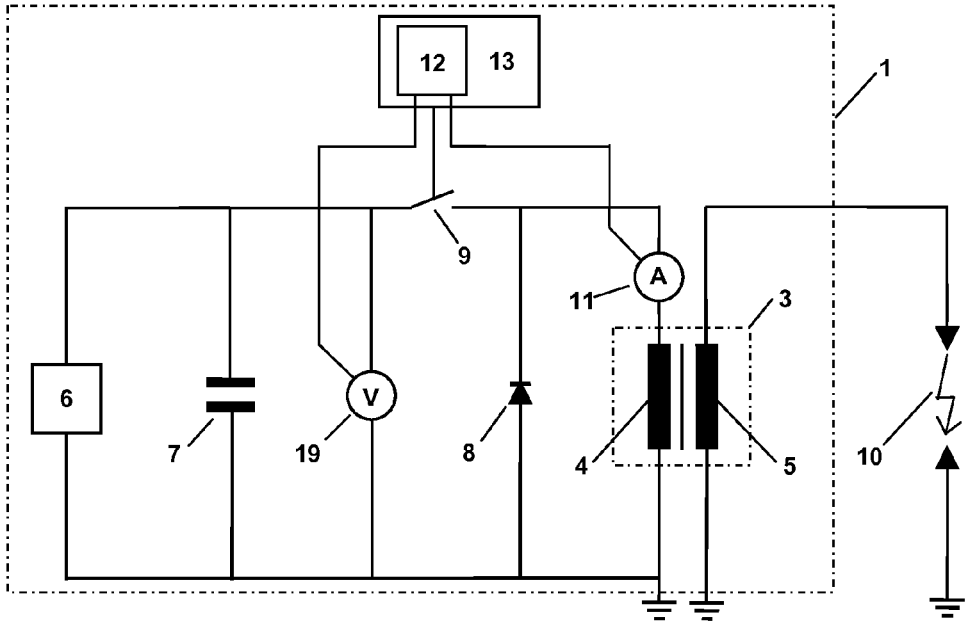
FIG. 3 shows a further embodiment of an ignition device according to the invention.

FIG. 3 shows a possible way of regulating the primary energy feed for optimizing the ignition spark energy and the ignition spark burning duration by the ignition spark burning duration measurement procedure by the evaluation provided according to the invention of the primary current measurement. In addition, FIG. 3 shows in comparison with FIG. 2 an evaluation device 12 to which the measurement signals from the measuring device 11 (here: ammeter) can be fed and subdivides the time variation of the primary current at least into a spark burning phase and a subsequent free-running phase of the high voltage transformer. The evaluation device 12 equates the transition from the spark burning phase into the free-running phase to the moment of extinction of the ignition spark.

As shown in FIG. 3, the evaluation device 12 is part of a regulating device 13 which uses the ignition spark duration ascertained by the evaluation device 12 as a regulating parameter for the primary-side energy feed to the high voltage transformer 3.

Figure 4:
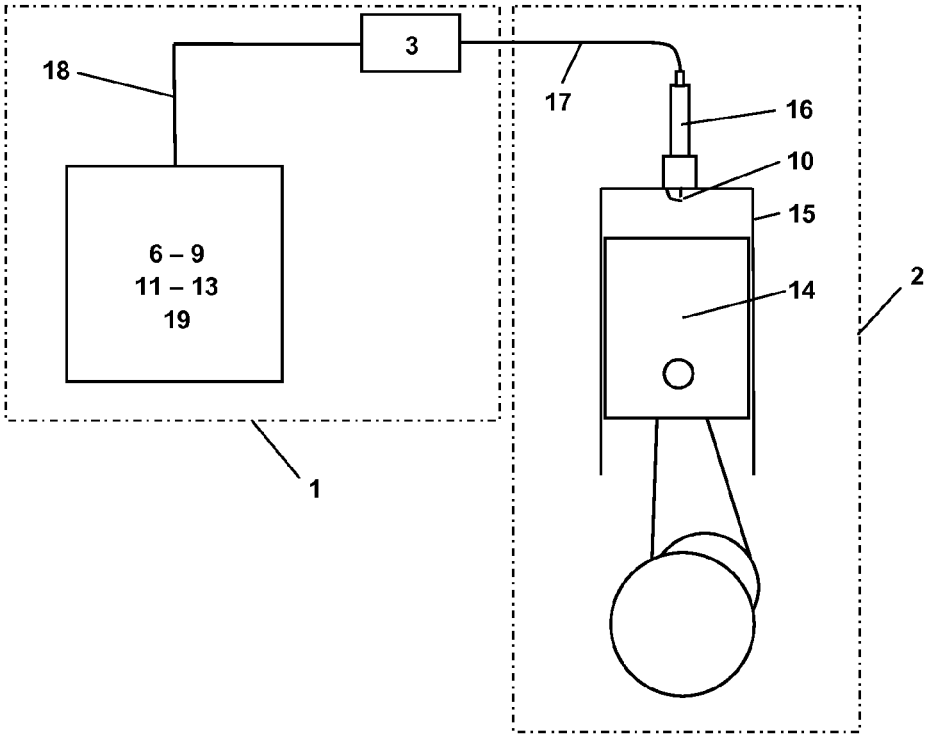
FIG. 4 shows an internal combustion engine having an ignition device according to the invention.

FIG. 4 diagrammatically shows an internal combustion engine 2 (of which only one piston-cylinder unit is shown) with an ignition device 1 according to the invention.

The piston-cylinder unit has a piston 14 which is arranged movably up and down in a cylinder 15. It is possible to see a spark path 10 which here is in the form of a spark plug 16 and which is electrically connected by way of a lead 17 to the secondary side 5 of a high voltage transformer 3 (here: ignition coil). The primary side 4 of the high voltage transformer 3 is electrically connected by way of a lead 18 to a high voltage source 6 through 9. FIG. 4 does not show the evaluation device 12 and the regulating device 13.

Figure 5:
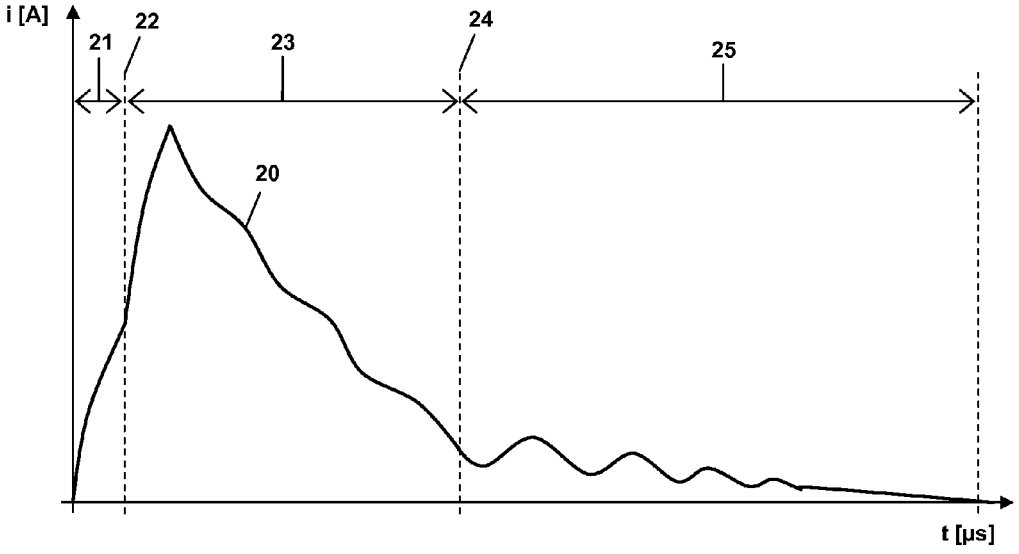
FIG. 5 shows a view of the time variation in the primary current and a view of the four different phases of the primary current variation.

FIG. 5 shows the variation in the primary current 20 of a high voltage transformer 3, in this case an ignition coil, divided into the four characteristic phases of an ignition spark, the ionization phase 21, the spark breakdown phase 22, the spark burning phase 23, the moment of extinction of the ignition spark 24 and the ignition coil free-running phase 25.

LEGEND

1 ignition device
2 internal combustion engine
3 high voltage transformer (ignition coil)
4 primary side of the high voltage transformer
5 secondary side of the high voltage transformer
6 dc voltage source
7 high voltage capacitor
8 free-running diode
9 switching element
10 spark path
11 measuring device for primary current measurement
12 evaluation device
13 regulating device
14 piston
15 cylinder
16 spark plug
17 high voltage line
18 line to the primary side of a high voltage transformer (ignition coil)
19 measuring device for measuring the capacitor voltage
20 primary current variation of the high voltage transformer (ignition coil)
21 ionization phase
22 spark breakdown phase
23 spark burning phase
24 spark extinction
25 ignition coil free-running phase

The invention claimed is:

1. A method of determining a moment of extinction of an ignition spark of an ignition device for an internal combustion engine, comprising:

measuring a time variation in a primary current flowing on a primary side of an ignition device, the ignition device having a high voltage transformer having the primary side and a secondary side, the primary side being connected to a high voltage source and the secondary side being connected to a spark path to provide the ignition spark;

subdividing the time variation in the primary current flowing on the primary side into at least a spark burning phase and a subsequent free-running phase of the high voltage transformer; and equating a transition from the spark burning phase into the free-running phase to the moment of extinction of the ignition spark by:

mapping the time variation of the primary current in the spark burning phase by a first function;

mapping the time variation of the primary current in the free-running phase by a second function; and equating an intersection point of the first function and the second function to the moment of extinction of the ignition spark.

2. The method of claim 1, wherein at least one of the first function and the second function is a polynomial function of degree >1 or a linear function.

3. The method of claim 1, wherein an ionization phase directly preceding the spark burning phase is identified in the time variation of the primary current, wherein a transition from the ionization phase into the spark burning phase is equated to a moment of occurrence of the ignition spark.

4. The method of claim 3, further comprising:

mapping the time variation of the primary current in the ionization phase by a third function; and equating an intersection point of the first function and the third function to the moment of occurrence of the ignition spark.

5. The method of claim 4, wherein at least one of the first function and the third function is a linear function.

6. The method of claim 5, wherein an ignition spark duration is determined based on the ascertained moment of extinction of the ignition spark, and based on the ascertained moment of occurrence of the ignition spark.

7. The method of claim 1, wherein an ignition spark duration is determined based on the ascertained moment of extinction of the ignition spark, and based on a previously-known or ascertained moment of occurrence of the ignition spark.

8. The method of claim 7, wherein the ignition spark duration is used as a regulating parameter for a primary-side energy feed to the high voltage transformer.

9. An ignition device for an internal combustion engine, comprising:

a high voltage transformer having a primary side and a secondary side;

a high voltage source electrically connected to said primary side of said high voltage transformer;

a spark path electrically connected to said secondary side of said high voltage transformer;

a measuring device for detecting a time variation in the primary current flowing through said primary side; and an evaluation device for receiving measurement signals from said measuring device, said evaluation device being configured to subdivide the time variation in the primary current into at least a spark burning phase and a subsequent free-running phase of said high voltage transformer, and said evaluation device being further configured to equate a transition from the spark burning phase into the free-running phase to a moment of extinction of the ignition spark;

wherein said evaluation device is further configured to further subdivide the time variation in the primary current into an ionization phase immediately preceding the spark burning phase, and to equate a transition from the ionization phase into the spark burning phase to a moment of occurrence of the ignition spark; and wherein said evaluation device is further configured to equate the transition from the spark burning phase into the free-running phase to the moment of extinction of the ignition spark by:

mapping the time variation of the primary current in the spark burning phase by a first function;

mapping the time variation of the primary current in the free-running phase by a second function; and equating an intersection point of the first function and the second function to the moment of extinction of the ignition spark.

10. The ignition device of claim 9, wherein said evaluation device is further configured to ascertain the ignition spark duration based on the moment of extinction of the ignition spark and based on the moment of occurrence of the ignition spark.

11. An internal combustion engine comprising said ignition device of claim 9.

12. The internal combustion engine of claim 11, further comprising a regulating device configured to regulate a primary-side energy feed of said high voltage transformer using the ignition spark duration ascertained by said evaluation device as a regulating parameter.

13. The internal combustion engine of claim 12, wherein said internal combustion engine is a stationary engine.

14. The internal combustion engine of claim 13, wherein said stationary internal combustion is a gas engine.

* * * * *